United States Patent [19]

Ellerbeck et al.

[11] Patent Number: 4,914,723

[45] Date of Patent: Apr. 3, 1990

[54] FLUORESCENT LAMP DISCHARGE TUBE HAVING ELECTROSTATICALLY COATED ENVELOPE

[75] Inventors: Roger P. Ellerbeck; Leslie J. George, both of Enfield; Peter W. Ranby, Harrow Weald; Peter J. Clewer, Hertford Heath, all of England

[73] Assignee: Thorn EMI plc, London, England

[21] Appl. No.: 137,916

[22] Filed: Dec. 28, 1987

Related U.S. Application Data

[60] Continuation-in-part of Ser. No. 813,241, Dec. 24, 1985, abandoned, which is a division of Ser. No. 586,754, Mar. 6, 1984, abandoned.

[30] Foreign Application Priority Data

Mar. 8, 1983 [GB] United Kingdom ..... 8306375

[51] Int. Cl.[4] ..... H01J 1/64

[52] U.S. Cl. ..... 313/493; 313/485; 427/67; 65/60.1; 65/60.3; 65/60.52; 356/73.1

[58] Field of Search ..... 313/493, 485; 65/29, 65/60.1, 60.3, 60.52; 356/73.1; 427/67, 71; 445/9, 10, 14; 252/301.36

[56] References Cited

U.S. PATENT DOCUMENTS

| | | | |
|---|---|---|---|
| 2,426,016 | 8/1947 | Gustin et al. | 427/67 X |
| 3,894,806 | 7/1975 | Remy et al. | 65/29 X |
| 4,081,714 | 3/1978 | Mossel et al. | 427/67 X |
| 4,404,255 | 9/1983 | Peiffer et al. | 65/60.3 X |
| 4,501,492 | 2/1985 | Douklias | 356/73.1 |

FOREIGN PATENT DOCUMENTS 1505628 3/1978 United Kingdom .

*Primary Examiner*—Donald J. Yusko
*Assistant Examiner*—Michael Horabik
*Attorney, Agent, or Firm*—Fleit, Jacobson, Cohn, Price, Holman & Stern

[57] ABSTRACT

A fluorescent lamp discharge tube has an electrostatically coated envelope. The coating comprises a mixture of 100 parts by weight of phosphor, 0.01 to 3 parts by weight of a fatty acid having a melting point greater than 40° C. or the ammonium, aluminum alkaline earth salts thereof, and 0.05 to 5 parts by weight of finely divided aluminum oxide having a grain size smaller than 0.1 micron. The phosphor is applied to the tube by a venturi effect and results in a more uniformly applied coating than is provided using a suspension coating. Uniformity of the coating is measured by the disclosed optical densitometry test.

5 Claims, 1 Drawing Sheet

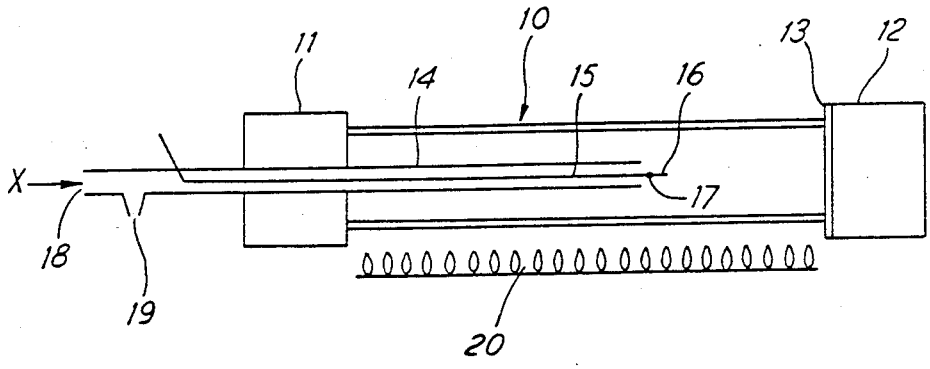
10
11
12
13
14
15
16
17
18
19
20
X

FLUORESCENT LAMP DISCHARGE TUBE HAVING ELECTROSTATICALLY COATED ENVELOPE

This is a continuation-in-part of application Ser. No. 813,241, filed Dec. 24, 1985, now abandoned, which in turn is a divisional of application of Ser. No. 586,754, filed Mar. 6, 1984, now abandoned.

This invention relates to a fluorescent lamp discharge tube having an electrostatically coated envelope. The phosphor can be a single phosphor or a mixture of phosphors, and the coating can be a single layer or multilayers.

During the production of fluorescent lamps, the inside surface of a glass tube is coated with a thin uniform layer of finely divided phosphor particles. This is usually accomplished by flushing or spraying the inside of the tube with a liquid suspension of the phosphor particles (the suspension coating method). The liquid medium incorporates an organic binding agent and provided the drying of the tube is carried out in an appropriate manner, a thin layer of the phosphor remains bonded to the glass surface. The glass tube is then heated to a temperature below the softening point of the glass but sufficiently high to bake off or burn off the organic binder. When all traces of the organic binder have been removed the coated tube is subjected to the further operations required in the manufacture of fluorescent lamps. If the need for coating using liquid suspension of phosphors could be eliminated substantial savings could be made in cost and time. Since organic liquids are often used in the suspension, the fire hazards and environmental pollution problems associated with using and evaporating large quantities of organic solvents could also be eliminted. There is therefore a great incentive to eliminate suspension coating and a known alternative involves coating using electrostatic methods. Unfortunately, and as far as is known at the present time, no commercially successful electrostatic method has been achieved and fluorescent lamps with envelops coated electrostatically with phosphor material are not believed to be commercially available. A main problem is that the adherence to the envelope wall is too low for the coating to remain on the envelope wall throughout all the further stages of lamp manufacture. A further problem is concerned with achieving the required uniformity of the layer of coating along the length of the envelope wall while at the same time achieving the required adherence. Moreover consideration must be given to achieving an acceptable luminance or light output level otherwise the finished lamp would not be commercially acceptable. In British Pat. No. 1 505 628 there is disclosed a method of electrostatically coating a low pressure mercury vapour discharge lamp envelope using a phosphor mixed with 0.01 to 1 percent by weight of stearic acid and/or palmitic acid and/or a stearate and/or a palmitate. This mixture includes from 0.1 to 3.0 percent by weight of an inorganic nitrate which is included, according to the patent, to increase the adhesion.

We have found that useful coatings can be produced without the inclusion of the inorganic nitrate and we have also found that a wider range of fatty acids may be used.

A fluorescent lamp discharge tube electrostatically coated with a mixture comprising 100 parts by weight of phosphor, 0.01 to 3 parts by weight of an organic adhesion aid comprising a fatty acid having a melting point greater than 40° C. or the ammonium, aluminum or alkaline earth salts thereof, and, in addition to said organic adhesion aid, an inorganic adhesion aid consisting solely of 0.05 to 5 parts by weight of finely divided aluminum oxide having a grain size smaller than 0.1 microns, wherein said discharge tube when subjected to an optical densitometry test comprising passing collimated light from a suitable source through said tube at right angles to the tube axis and along a diameter at points near each end and measuring the brightness of the transmitted light exhibits a percentage light transmission reading when compared with an uncoated tube of the same glass and dimension of less than 15 percentage units and wherein the reading taken near an end of the tube differs from that taken near the other end of the tube by no more than 1.2 of said units.

Suitable fatty acids for incorporation in the above mixture include lauric, myristic, stearic and palmitic acids and their salts. We have found that lauric and myristic acids and their salts are particularly effective in producing a coating which is of good adherence. It is further believed that these acids improve the electrostatic properties of the phosphor so that a better coating is achieved.

The amount of finely divided aluminium oxide is preferably, for best results, between 0.5 and 5 parts by weight and most conveniently is from 0.5 to 3 parts by weight.

It has been found that envelopes in accordance with the invention are more uniformly coated than those produced by the suspension coating method, which latter method tends to deposit more phosphor at one end of the envelope than the other. The optical densitometry test described hereinafter compares measurements made near each end of envelopes of the present invention and envelopes made using the suspension coating and demonstrates a difference between ends of not greater than 1.2 percentage units for our method compared with a difference of at least 1.5 percentage units for suspension coated envelopes. Preferably the same difference is less than 1.0 of said units and, in the best cases, less than 0.5 of said units.

The invention will now be described by way of example only and with reference to the accompanying drawing which is a schematic arrangement of apparatus used in practising the invention.

An example of a phosphor used in the present invention was made up as follows:

0.6 gms of an organic adhesion aid, lauric acid $CH_3(CH_2)_{10}COOH$, is dissolved in approximately 50 mls of acetone and this solution is stirred with 120 gms of any conventional halophosphate lamp phosphor to make a smooth paste. Stirring is continued in a fume cupboard until all the acetone has evaporated. When dry the powder is heated to 120° C. for half an hour in an oven. A quantity of 2 gms of finely divided aluminum oxide having an average particle size smaller than 0.1 microns is then added as an inorganic adhesion aid and the mixture passed through a 175 mesh nylon sieve to remove any agglomerates; the subsequent mixture is then ready for use. It should be noted that, following tests that we have conducted, it was found that the inclusion of an inorganic nitrate, for example, $Ca(NO_3)_2$ caused a deterioration in lumen output. For this reason we do not include any inorganic nitrate with our luminescent phosphor material, and, as in the above-described composition, the inorganic adhesion aid consists solely of oxide. Despite this, we have surprisingly been able to achieve the necessary adhesion of the phosphor and without detriment to the lumen output of a completed lamp made in this manner. The above mixture, then, devoid of any inorganic nitrate, is electrostatically coated using the method of the invention onto a tubular lamp envelope using the apparatus disclosed in the accompanying drawing.

In the drawing, reference numeral 10 denotes a tubular glass envelope to be coated and which will form an envelope for a fluorescent lamp. The envelope 10 is held between two holders 11 and 12 by means of which it can be supported and rotated during the coating process. A spring load chuck member 13 allows the envelope to be conveniently loaded into the holders 11 and 12. A hollow probe 14 carries inside it an insulated high tension lead 15 having an uninsulated tip forming a high tension electrode 16 adjacent the open end 17 of the probe 14. A carrier gas stream, such as air or nitrogen (indicated by arrow X) is introduced at the other end 18 of the probe 14 and carries the luminescent phosphor material past the open end 17 of the probe 14, past the high tension electrode 16 so that it becomes charged and electrostatically deposited on the inside surface of the tubular envelope 10. The phosphor is uniformly introduced into the carrier gas stream. This is advantageously done by a venturi effect, using a venturi opening 19 in the probe 14. The tubular envelope 10 and probe 14 are movable relative to each other and a relative traverse speed whereby a four foot long envelope is coated in 6/7 seconds is satisfactory. An important part of the present invention is the uniform heating of the tubular envelope achieved by the closely spaced gas jets denoted by the reference numeral 20. The flames of the gas jets heat the tubular envelope to about 100° C., although a range between 80° C. and 250° C. would suffice, as well as serving to ground the tubular envelope.

It is found that heating of the phosphor prior to entry into the carrier gas stream is not necessary, nor does the humidity of the atmosphere appear to affect the results so that moistening of the phosphor and/or a pre-drying step can be dispensed with, as can any flushing of the coated tube with superheated steam.

As stated above the envelopes according to the present invention may be subjected to an optical densitometry test and the results in terms of difference between the two ends of the envelopes can be compared with similar results obtained using the same test on suspension coated envelopes.

In our optical densitometry test, collimated light from a suitable source is passed through the coated tubular envelope (which may be in the form of a finished lamp) at right angles to the tube axis and along a diameter at points near each end and the brightness of the light transmitted is measured by means of a photo cell. The results are not of course absolute measurements of optical transmission but do give an indication of variation (or otherwise) from one coated tubular envelope to another and between the two ends of each envelope. The measurements are taken (for a typical lamp of any of the standard lengths (2 feet to 8 feet)) about 3 inches in from each end of the envelope; the reason for measuring at this point is that the lamp filament of a finished lamp would interfere at points nearer to the end. It is important when carrying out the measurements to do so with the lamp housing, the tube, and the photo cell all in the same relative position to each other. Preferably lamps being tested should be operated from a voltage stabilised supply. The lamp used in our particular test is a 12 v 50 W projector lamp (but other lamps would be suitable), the photo cell is a Megatron eye corrected type MF and the readings from the photo cell are taken from a digital meter.

A number of suspension coated lamps and lamps produced by the present invention (all lamps were four feet in length) were examined using the above test. Readings were taken at a point 3 inches from one end of each lamp (point A) and at a point 3 inches from the other end of the same lamp (point B). The reading from the digital meter associated with the photocell was expressed as a percentage of a control reading using an uncoated envelope of the same glass and dimensions and, in all cases was less than 15 percent of the control reading and, specifically, between 4 and 11 percent. Table I below shows the results for some 23 lamps coated electrostatically by the method of the present invention.

TABLE I

| Electrostatically Coated Lamps - Percentages | | |
|---|---|---|
| Point A | Point B | Difference |
| 6.4 | 5.8 | 0.6 |
| 5.9 | 5.8 | 0.1 |
| 6.3 | 5.6 | 0.7 |
| 5.5 | 5.3 | 0.2 |
| 6.1 | 6.1 | 0 |
| 5.8 | 5.3 | 0.5 |
| 7.3 | 6.2 | 1.1 |
| 8.0 | 6.8 | 1.2 |
| 7.2 | 6.8 | 0.4 |
| 6.6 | 6.3 | 0.3 |
| 6.5 | 6.1 | 0.4 |
| 6.8 | 6.1 | 0.7 |
| 7.4 | 6.5 | 0.9 |
| 6.4 | 6.2 | 0.2 |
| 6.9 | 6.8 | 0.1 |
| 7.6 | 7.2 | 0.4 |
| 7.6 | 6.4 | 1.2 |
| 7.0 | 6.2 | 0.8 |
| 6.8 | 6.4 | 0.4 |
| 6.8 | 6.6 | 0.2 |
| 7.2 | 7.1 | 0.1 |
| 6.1 | 6.1 | 0 |
| 5.6 | 5.1 | 0.5 |

From these results it can be seen that the difference is in no case greater than 1.2 percent, in most cases less than 1.0 percent and in many cases less than 0.5 percent.

For comparison, the same experiment carried out on 28 suspension coated lamps gave the results shown in Table II:

TABLE II

| Suspension Coated Lamps - Percentages | | |
|---|---|---|
| Point A | Point B | Difference |
| 8.2 | 5.5 | 2.7 |
| 7.9 | 5.1 | 2.8 |
| 6.9 | 4.6 | 2.3 |
| 7.0 | 5.2 | 1.8 |
| 7.2 | 5.4 | 1.8 |
| 7.4 | 5.5 | 1.9 |
| 7.2 | 5.7 | 1.5 |
| 7.2 | 5.3 | 1.9 |
| 8.0 | 5.4 | 2.6 |
| 7.3 | 4.6 | 2.7 |
| 8.1 | 5.7 | 2.4 |
| 9.0 | 5.2 | 3.8 |
| 7.4 | 5.1 | 2.3 |
| 7.1 | 5.5 | 1.6 |
| 7.8 | 5.4 | 2.4 |
| 7.4 | 5.0 | 2.4 |
| 7.5 | 5.1 | 2.4 |

TABLE II-continued

| Suspension Coated Lamps - Percentages | | |
|---|---|---|
| Point A | Point B | Difference |
| 7.6 | 5.0 | 2.6 |
| 7.6 | 5.7 | 1.9 |
| 7.0 | 4.9 | 2.1 |
| 6.7 | 4.6 | 2.1 |
| 6.8 | 4.5 | 2.3 |
| 7.0 | 4.6 | 2.4 |
| 6.6 | 4.7 | 1.9 |
| 6.3 | 4.7 | 1.6 |
| 10.2 | 6.0 | 4.2 |
| 8.8 | 5.7 | 3.1 |
| 9.1 | 5.6 | 3.5 |

In this case, it can be seen that the difference is in all cases in the range of 1.5 to 4.2 percent.

We claim:

1. A fluorescent lamp discharge tube electrostatically coated with a mixture comprising 100 parts by weight of phosphor, 0.01 to 3 parts by weight of an organic adhesion aid comprising a fatty acid having a melting point greater than 40° C. or the ammonium, aluminum or alkaline earth salts of such a fatty acid, and, in addition to said organic adhesion aid, an inorganic adhesion aid consisting solely of 0.05 to 5 parts by weight of finely divided aluminum oxide having a grain size smaller than 0.1 microns, wherein said discharge tube when subjected to an optical densitometry test comprising passing collimated light from a suitable source through said tube at right angles to the tube axis and along a diameter at points near each end and measuring the brightness of the transmitted light exhibits a percentage light transmission reading when compared with an uncoated tube of the same glass and dimension of less than 15 percentage units and wherein the reading taken near an end of the tube differs from that taken near the other end of the tube by no more than 1.2 of said units.

2. A fluorescent lamp discharge tube according to claim 1 wherein the difference in said readings taken near each end of the discharge tube is less than 1.0 of said units.

3. A fluorescent lamp discharge tube according to claim 2 wherein the difference in said readings taken near each end of the discharge tube is less than 0.5 of said units.

4. A fluorescent lamp discharge tube according to claim 1 wherein said readings taken near each end of the discharge tube are taken at points three inches from each end.

5. A fluorescent lamp discharge tube according to claim 1 wherein said fatty acid is selected from the group consisting of lauric acid, myristic acid, stearic acid and palmitic acid.

* * * * *